United States Patent [19]

Saotome

[11] 4,379,705

[45] Apr. 12, 1983

[54] LIFE BELT

[76] Inventor: Hikoji Saotome, 1-12-10 Naka-Kokubo, Ichikawa-shi, Chiba-ken, Japan

[21] Appl. No.: 294,359

[22] Filed: Aug. 19, 1981

[30] Foreign Application Priority Data

Aug. 22, 1980 [JP] Japan ..... 55-118989[U]

[51] Int. Cl.[3] ..... B63C 9/16

[52] U.S. Cl. ..... 441/94; 441/108

[58] Field of Search ..... 441/88, 90, 92, 93, 441/94, 95, 108, 111, 112, 113

[56] References Cited

U.S. PATENT DOCUMENTS 1,253,034 1/1918 Heyward ..... 441/112
1,367,225 2/1921 Barker .
2,784,426 3/1957 Boyle et al. ..... 441/111
3,510,025 5/1970 Turner, Jr. .

FOREIGN PATENT DOCUMENTS 219922 2/1959 Australia ..... 441/88

*Primary Examiner*—Charles E. Frankfort
*Assistant Examiner*—Rodney Corl
*Attorney, Agent, or Firm*—Fleit, Jacobson & Cohn

[57] ABSTRACT

A life belt comprising a ring shaped tubular body which incorporates a device for fastening the tubular body around a waist of a person, a compressed gas containing capsule connected to the tubular body and an actuator for releasing the compressed gas into the tubular body to inflate the tubular body, in which the tubular body has a first portion and a second portion. The second portion is obliquely bent downward at about 120°-160° relative to the first portion.

4 Claims, 10 Drawing Figures

LIFE BELT

BACKGROUND OF THE INVENTION

The present invention relates to an inflatable life belt or life buoy, which may be worn by a person and inflated when buoyancy in the water is required.

In view of frequent disaster, shipwreck and accidents of fishermen, development of simple structured life buoys has been sought. Heretofore, various types of inflatable life buoys were suggested such as a floatation jacket or vest and inflatable belt as shown, for example, in U.S. Pat. No. 1,367,225 to W. H. Baker and U.S. Pat. No. 3,510,025 to J. G. Turner, Jr. These known life jacket and life belt, however, were found to be undesirable. The jacket type buoyancy aid is not suitable for those who are engaged in heavy physical labors such as working on fishing boats and a harbor working, because wearing such jacket type buoyancy aid will cause the workers to be in a sweat or perspiration, and it is likely that the workers often feel cramped and pinched. Further, the jacket type buoys cause a hindrance to working.

The known ring shaped life belt as shown in the aforesaid U.S. Patent to Baker requires the person, when inflated, to firmly hold with his arms to prevent his body from dropping into water and to maintain a stable posture of his body relative to the inflated belt, and it will not be suitable for a floatation of long period of time. Particularly when a shock or injury to the person at the time of, for example, falling into the water does not permit a free movement of arms of the person, safety of the person will not be assured.

SUMMARY OF THE INVENTION

An object of the present invention is to provide an improved belt type inflatable buoyancy aid, which permits a person to be in a safe backward inclination posture when it is inflated in the water without requiring the person to grasp the inflated belt with his arms.

Another object of the present invention is to provide an improved life belt which can be readily worn by a person and fit to his waist and does not prevent his working and activities.

Briefly, the inventive life belt has ring shaped tubular body incorporating a device for fastening the tubular body around a waist of a person, a compressed gas containing capsule connected to the tubular body, and an actuator for releasing the compressed gas into the tubular body to inflate the tubular body, wherein the tubular body has a first portion and a second portion which is formed bent at about 120°–160° relative to the first portion so that the second portion, when inflated, is inclined downwardly and located in front of person's body or chest.

DETAILED DESCRIPTION OF THE INVENTION

Figure 1:
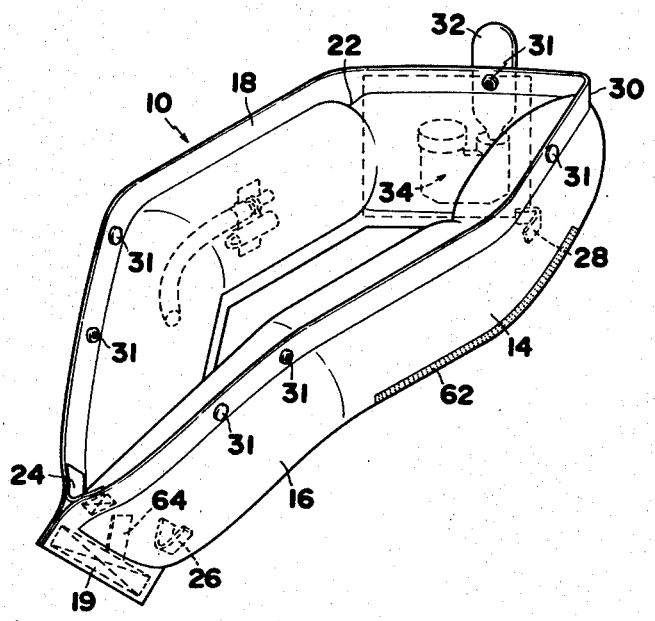
FIG. 1 is a perspective view of an inventive life belt, showing the structure thereof when it is inflated for use.

Like reference numerals represent like parts in the various views of the drawings.

Figure 1A:
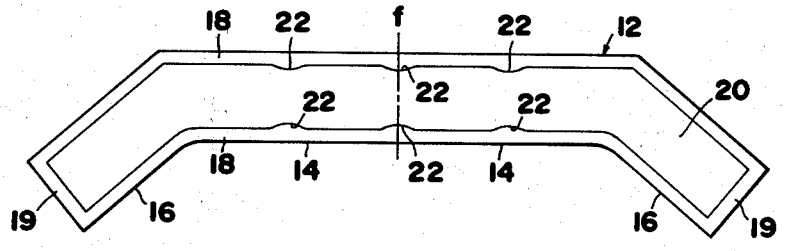
FIG. 1A is a plan view of a sheet member which forms the life belt shown in FIG. 1.
Figure 2:
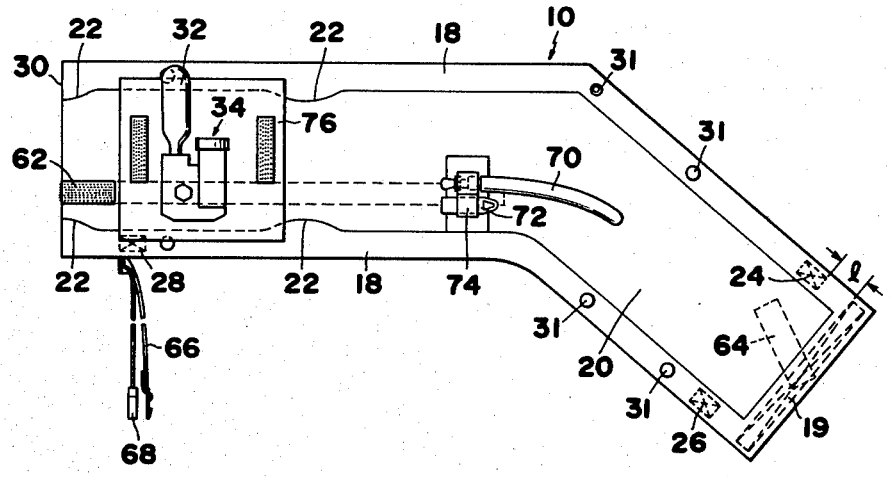
FIG. 2 is a plan view of the life belt, when it is deflated, shown in FIG. 1.

Referring first to FIGS. 1, 1A and 2, an inflatable life belt, which is designated generally at 10, is formed basically with two thin sheet members 12 of rubber, preferably of nylon treated with neoprene rubber, which are formed symmetrical as illustrated in FIG. 1A. The thin sheet members 12 each has a first portion 14 extending transversely in the opposite direction relative to a vertical center line f and a second portion 16 at the extended ends of the first portion 14. The second portion 16 is formed bent downwardly at about 140° relative to the lengthwise direction of the first portion 14. The thus shaped two thin sheet members 12 are superposed together and sealed at their all circumference to form flanges 18, 19 and a sealed chamber 20 with constrictions 22. The contsrictions are formed in a confronting relations and at a predetermined interval at the upper and lower flanges 18, as illustrated in FIG. 1A. The constrictions 22 are all formed in the first portion 14, wherein a pair of them is formed symmetrically at the center vertical line f. The thus formed inflatable sheet members 12, which have been sealed together at their circumference, are then folded at the center line f so that the end flanges 19 of the second portion 16 are fixed together to form a substantially ring shaped structure.

Figure 3:
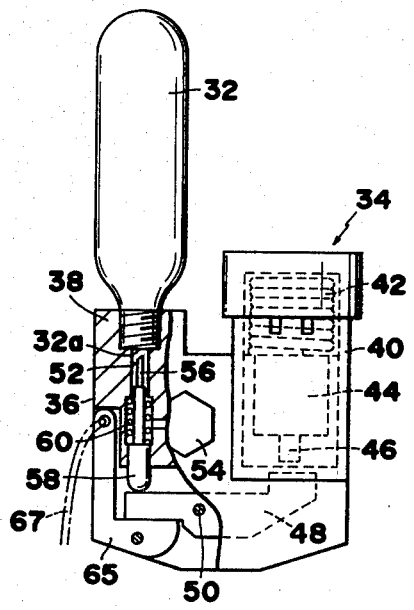
FIG. 3 is a partly sectioned side view of an actuator for inflating the life belt.

Strips 24, 26 of cloth or any other flexible material are provided at the upper and lower flanges 18 to bridge the same adjacent to the end flanges 19 with a distance l from the end flanges 19. The strips 24, 26 facilitate the obliquely extended second portion 16 to be closely positioned when the life belt 10 is inflated, and can prevent the second portions 16 from excessively separated from each other when inflated. Similarly, another strip 28 is provided at the lower flange 18 of the opposite end portion 30 which is the portion folded at the center line f in FIG. 1A. Although not illustrated, additional strip may be provided at the upper flange 18 of the end portion 30. The thus formed life belt 10 can be inflated to a bulge shaped or oblong buoyancy aid as illustrated in FIG. 1 by actuation of a capsule 32 of compressed or liquified gas or air. A plurality of male and female fastners 31 are disposed at the upper and lower flanges 18. The capsule 32, which is connected to the gas chamber 20 of the life belt 10, is mounted to an actuator 34, as illustrated in FIG. 3. The actuator 34 has a casing 36 which incorporates a socket 38 for mounting therein the capsule 32 and a cylindrical housing 40 for securing therein a spiral spring 42 and a spring retainer 44 which is made, for example, paper or the like which can maintain the spring 42 in a compressed state but permits the spring to urge by its resilient force when the paper is wetted and deformed or destructed. At the bottom of the spring retainer 44, a pusher 46 is provided so that it can push a lever 48 which is pivotally secured within the casing 36 at 50. The socket 38 has a gas channel 52 connected to the chamber 20 of the life belt 10 through a valve 54. A needle 56 projecting towards a sealing end 32*a* of the capsule is mounted within the channel 52. The needle 56 has an enlarged head 58 which is in an abutment relation with the lever 48 so that the needle 56 is projected against the sealing end 32*a* of the capsule 32 against a resilient force of a spring 60 when the lever 48 is actuated by the resilient force of the spiral spring 42. Thus, the needle 56 is automatically projected when the spring retainer of paper 44 is wetted. Reference numerals 65 is an L-shaped auxiliary lever for a manual operation in case that the aforesaid automatic actuator should not be actuated. A manual actuation of the L-shaped lever 65 by means of a string 67 can project the needle 56 against the end 32*a* of the capsule to permit an abrupt flowing of the compressed gas into the life belt 10 as well.

The inflatable life belt 10 has an elongated fastener band 62 on its outer lower surface while a fastener strip 64 which can be engaged with the fastener band 62 is provided such that an end of the fastener strip 64 is fixed to the end flange 19. At the opposite end 30 where the sheet members 12 are folded at f, there is provided a belt or string 66 with a buckle 68. Reference numerals 70 and 72 are auxiliary hose for supplying air into the life belt 10 when it is deflated after a long time floatation and a whistle, respectively. The auxiliary hose 70 and whistle 12 are held in position by a suitable supporter 74. Of course, the auxiliary hose 70 has a back-flow valve, though not shown, so that air or gas in the inflated life belt does not flow back through the hose 70. Reference numeral 76 represent a cushion plate of, for example, polyethelene sheet disposed between the inflatable life belt and the actuator 34 with a capsule 32.

Figure 4A:
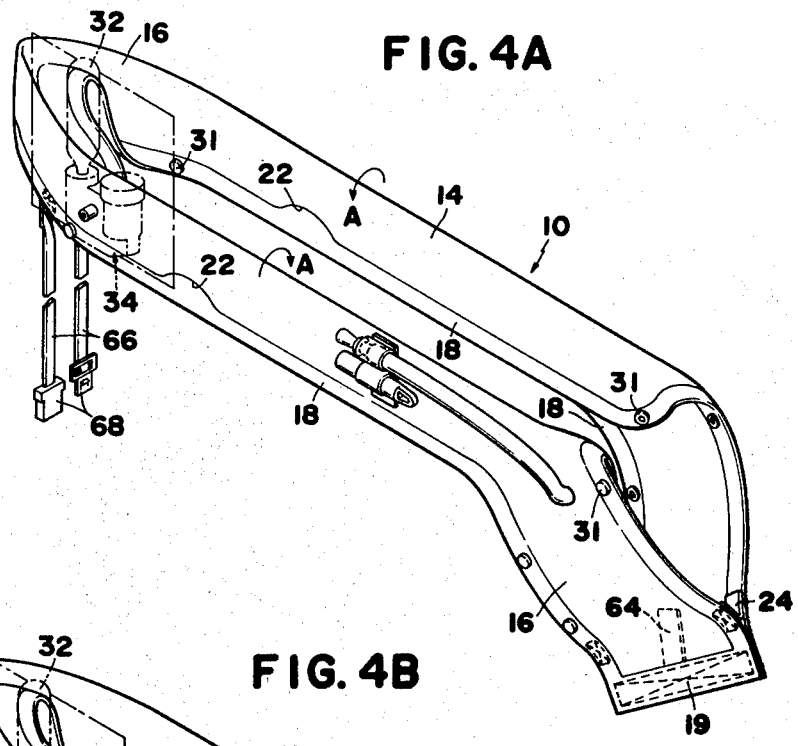
FIGS. 4A, 4B and 4C are perspective views of the life belt, showing a method of wearing it around the waist of the person.
Figure 4B:
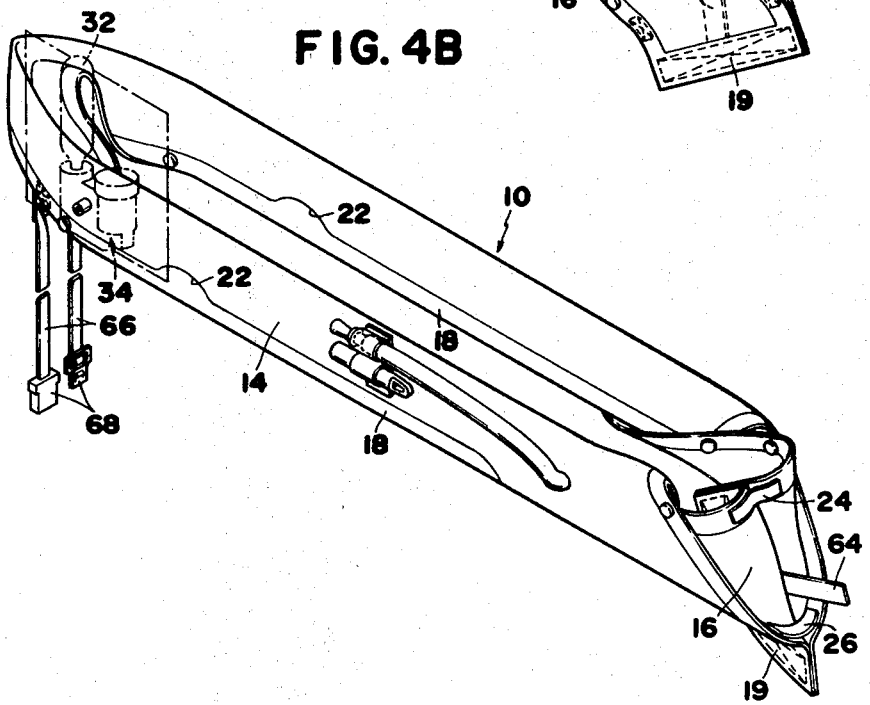

An operation will be described with reference to FIGS. 4A, 4B, 4C and 5. An upper half of the inflatable life belt 10 is folded inwardly at its first portion 14 as shown by arrows A of FIG. 4A so that the upper and lower flanges 18 are fastened together by the fasteners 31. In this instance, the second portion 16 of the life belt is folded in an inside-out manner as illustrated in FIG. 4B so that the fastener strip 64 of the opposite end 30 may project outside the folded life belt 10 and the elongated fastner band 62 which can be engaged with the fastener strip 64 appears outside the folded life belt 10.

Figure 4C:
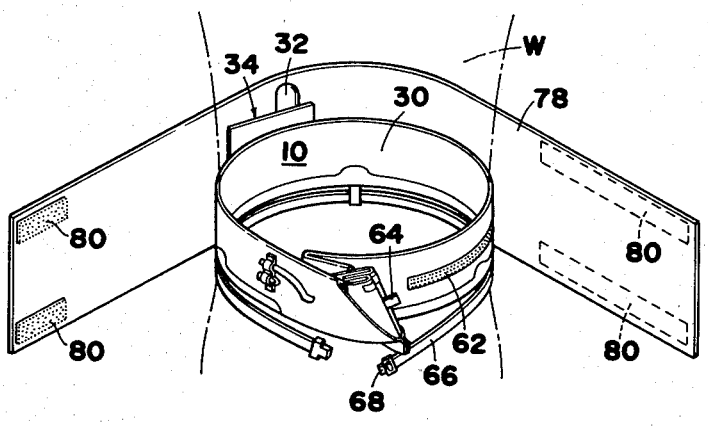

After the life belt is folded as described, the ring shaped life belt 10 is positioned around a waist W of the person as shown in FIG. 4C such that the strip 28 at the opposite end portion 30 is positioned adjacent to person's backbone, or at the central back of the waist W. Then the supporting helt 66 is loosely fastened around the waist W by means of the buckle 68 so that the end portion 30 the life belt 10 is accurately positioned at the central back of the waist W. After that, the life belt is fitted around the waist W of the person and the fastener strip 64 is engaged with the elongated fastener band 62. After the life belt 10 is fitted around the waist of the person, a cover belt 78 which has fasteners 80 is wound over the life belt 10 to protect the actuator 34 with capsule 32 and to prevent the life belt 10 which has been fitted around the waist W from being released.

Figure 5:
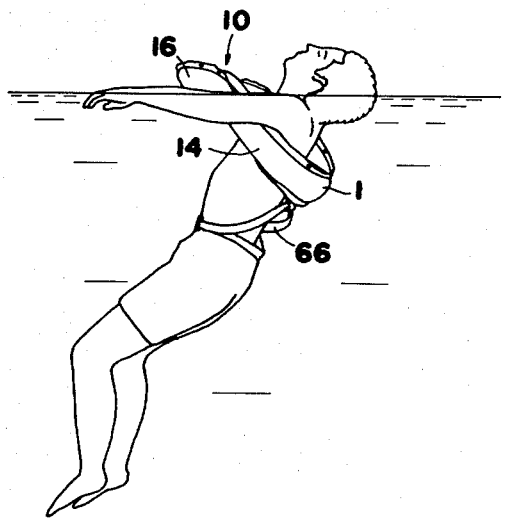
FIG. 5 shows the life belt in use.

Assuming that the person who wears the inventive life belt is dropped into the water, water comes into the cylindrical housing 40 of the actuator 34 to collapse the paper-made spring retainer 44 to thereby permit the pusher 46 to push the needle 56 through the lever 48 by means of the resilient force of the spring 42. Thus the needle 56 projects against the sealed end 32*a* of the capsule 32 to permit the compressed or liquified gas or air in the capsule 32 to flow abruptly into the chamber 20 to inflate the life belt 10, as shown in FIGS. 1 and 5. In this instance, engagement of the fasteners, of course, of the life belt as well as of the cover belt 18 are forcibly released by the inflation of the life belt 10.

The life belt 10, when inflated, has an inverted bulge shape, and the inflated second portions 16 are closely positioned to each other and to person's chest. Thus, the life belt 10 is maintained around the chest of the person without requiring the person to endevour to grasp the life belt 10 with his arms. As described, the life belt 10 has the first portion 14 and the second portion 16 wherein the second portion 16 extends obliquely downwardly relative to the first portion 14. Because of the buoyancy of the obliquely extended second portion, the first portion 14 is slightly sunk by person's weight, and the person can take a rearwardly inclined posture with his face being maintained upward as illustrated in FIG. 5. Accordingly, the person will not be drowned even if he is fainted.

Figure 6:
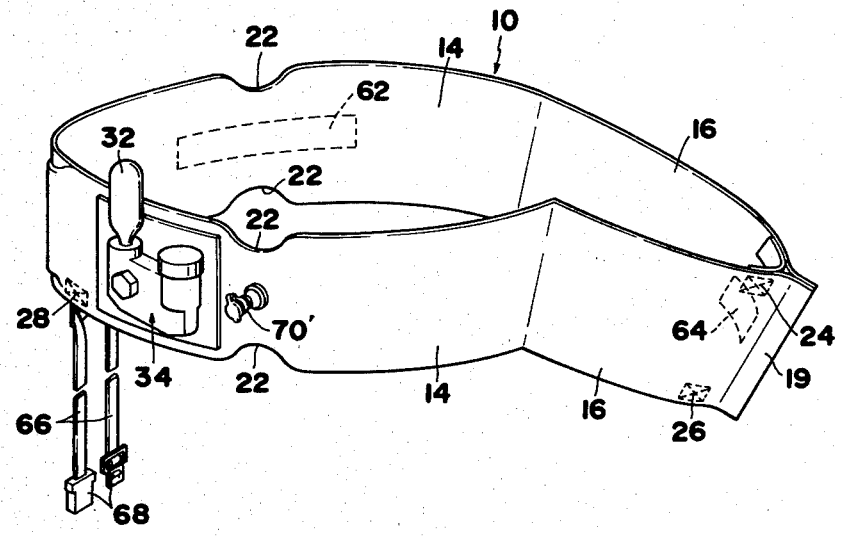
FIGS. 6 and 7 are perspective views of life belts according to other embodiments of the invention.

FIG. 6 shows a more simplified structure of a life belt according to the invention, in which the modified life belt 10 is fitted around the waist of the person without folding a first portion 14 of the life belt 10. The life belt 10 in this embodiment is not provided with the male and female fasteners which are shown at 31 in, for example, FIG. 4A of the previous embodiment. In the simplified structure of FIG. 6, the life belt 10 has an elongated fastener band 62 attached to an outer surface thereof and a fastening strip or band 64 attached to the other outer surface of the belt 10 so that life belt is fitted around the waist of the person by the fastners 62, 64. As similar as the structure of the previous embodiment shown in FIGS. 1 through 5, the life belt 10 has a first portion 14 with constrictions 22 and a second portion 16 which is obliquely downwardly extended relative to the longitudinal direction of the first portion 14. The inflatable life belt 10 is connected together at the ends thereof to form an end flange 19, and provided with strips 24, 26 adjacent to the end flange 19 for preventing the second portions 16 from being undesirably separated from each other when inflated. Other parts and elements such as an actuator 34 with capsule 32, a belt 66 with a buckle 68, and another strip 28 which is disposed at the position opposite to the end flange 19 are understood to be substantially similar to those of the previons embodiment. Reference numeral 70′ is an axiliary air supply valve which is understood to be correspondent with the auxiliary hose 70 of the previous embodiment.

Figure 7:
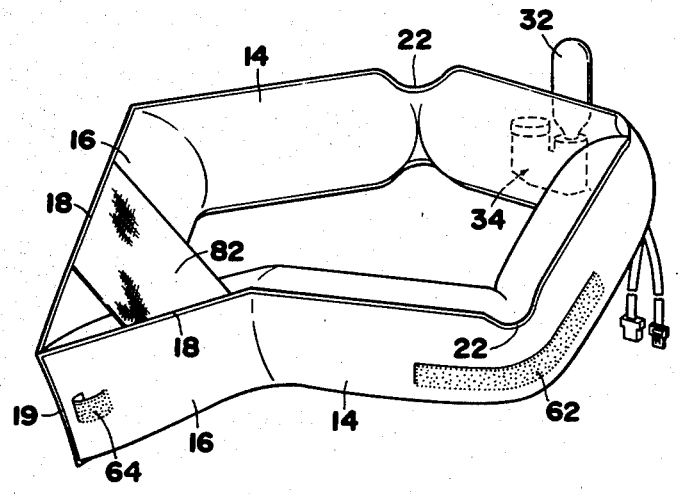

FIG. 7 shows a further modification in which a cloth 82 is provided so that one end of which is connected to an upper flange 18 of one of the second portion 16 while the other end of which is connected to the upper flange of the other second portion 16 of the life belt 10. The cloth 82, which will be stretched fully when the life belt 10 is inflated, has a function to prevent the person from his face, particularly his nares, being dropped into the water and can support his face above the water. Other parts and elements such as the actuator 34 with a capsule 32, fastening devices 62, 64 are similar with those of the aforementioned embodiments of the invention, and a further detailed description will not be made. It will be understood that the cloth 82 can be provided to the life belts of the previous embodiments.

Although the present invention has been described with reference to the preferred embodiments in which the second portion 16 is inclined at about 140° relative to the first portion 14, the angular degree as described may be selected within the range from about 120° to about 160°. This range can maintain the person, when in use, in a desired, safe backwardly inclined posture (about 60° relative to a vertical line to the water surface) with his mouth being spaced at least 10 cm apart above the water surface.

What is claimed is:

1. A life belt comprising an annular inflatable tubular body, means for releasably fastening said tubular body around the waist of a person, said means being releasable when said tubular body is inflated for use, a capsule containing therein compressed gas for inflating said tubular body, and an actuator for releasing the compressed gas into said tubular body to thereby inflate said tubular body, wherein said tubular body is made of two symmetrically extending sheet members, said sheet members each having a first longitudinal sheet portion and second sheet portions at the ends of said first sheet portion, said second sheet portions being inclined downwardly at about 120°–160° relative to the longitudinal direction of said first portion, said sheet members being sealed together at their circumference to form a life belt base in a symmetrical structure with a gas chamber formed therein, said life belt base being folded at its middle portion and connected at its ends together to thereby form an annular shape, strips being provided on the second sheet members and adjacent to said ends of said life belt base, thereby maintaining said second portions in a closely contacted manner to each other when said life belt is inflated.

2. The life belt according to claim 1, in which said life belt has constrictions on the first portion at a predetermined interval.

3. The life belt according to claim 2, in which said tubular body has flanges on its upper and lower portions, said constrictions being formed at said flanges.

4. An inflatable life belt comprising:

two sheet members each having a first middle portion and second end portions in a symmetrical shape, said second end portions being extended from said first middle portion in an opposite direction and inclined at about 120°–160° relative to a longitudinal direction of said first middle portion, said two sheet members being sealed together at their circumferences to form as upper flange, lower flange and two end flanges to thereby form a sealed gas chamber, said sheet members sealed together being folded such that said end flanges of the second portions are connected together to thereby form an annular inflatable tubular body, means for releasably fastening said tubular body around the waist of a person who uses the life belt, a capsule containing therein compressed gas for inflating said life belt, and an actuator for releasing the gas into said life belt for inflation.

* * * * *